US010063001B2

(12) United States Patent
Williams et al.

(10) Patent No.: US 10,063,001 B2
(45) Date of Patent: Aug. 28, 2018

(54) GATED CONNECTOR RECEPTACLES

(71) Applicant: Apple Inc., Cupertino, CA (US)

(72) Inventors: Reuben J. Williams, Cupertino, CA (US); James M. Jeon, Cupertino, CA (US); Jonathan A. Matheson, Cupertino, CA (US); Mahmoud R. Amini, Sunnyvale, CA (US); Daniele G. De Iuliis, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/275,227

(22) Filed: Sep. 23, 2016

(65) Prior Publication Data

US 2018/0090869 A1 Mar. 29, 2018

(51) Int. Cl.

| | |
|---|---|
| ***H01R 13/453*** | (2006.01) |
| ***H01R 13/44*** | (2006.01) |
| ***H01R 24/64*** | (2011.01) |
| ***H01R 13/658*** | (2011.01) |
| *H01R 107/00* | (2006.01) |

(52) U.S. Cl.

CPC ..... *H01R 13/44* (2013.01); *H01R 13/453* (2013.01); *H01R 13/658* (2013.01); *H01R 24/64* (2013.01); *H01R 13/4534* (2013.01); *H01R 2107/00* (2013.01)

(58) Field of Classification Search

CPC ..... H01R 27/00; H01R 13/44; H01R 13/658; H01R 24/64; H01R 13/35; H01R 13/453; H01R 13/4532; H01R 13/4534; H01R 13/4536; H01R 13/4538

USPC ..... 439/137, 138, 166, 170, 173, 174, 175, 439/218, 221, 223, 681, 607.23, 607.33, 439/607.25

See application file for complete search history.

(56) References Cited

U.S. PATENT DOCUMENTS

| | | | | |
|---|---|---|---|---|
| 4,973,859 | A * | 11/1990 | Shodai | B60R 21/0176 280/735 |
| 5,559,672 | A * | 9/1996 | Buras, Jr. | G06F 1/1656 361/679.32 |
| 6,547,585 | B2 * | 4/2003 | Bradley | H01R 13/633 439/353 |
| 7,108,530 | B2 * | 9/2006 | Kimura | G06K 7/0013 361/755 |
| 7,431,595 | B1 * | 10/2008 | Yen | G06K 7/0021 439/138 |
| 7,867,034 | B1 * | 1/2011 | Sato | G06K 7/0043 439/159 |
| 7,887,370 | B2 * | 2/2011 | Chen | H01R 13/506 439/607.35 |
| 8,764,465 | B2 * | 7/2014 | Huang | H01R 13/453 439/138 |

(Continued)

*Primary Examiner* — Renee S Luebke
*Assistant Examiner* — Paul Baillargeon
(74) *Attorney, Agent, or Firm* — Kilpatrick Townsend & Stockton, LLP

(57) ABSTRACT

Connector receptacles that are arranged to avoid inadvertent connections. One example may provide contacts for a first connector receptacle that may be located behind a movable gate. The first connector receptacle may be combined with a second connector receptacle that is user accessible to save space and simplify device assembly. Combining the first connector receptacle and a second connector receptacle may also remove the movable gate from a surface of an electronic device, thereby further preventing inadvertent connections.

22 Claims, 17 Drawing Sheets

(56) References Cited

U.S. PATENT DOCUMENTS

| | | | | |
|---|---|---|---|---|
| 8,770,860 | B2 * | 7/2014 | Affre De Saint Rome | G02B 6/3849 385/55 |
| 9,601,861 | B2 * | 3/2017 | Kanamori | H01R 13/4532 |
| 2012/0088412 | A1 * | 4/2012 | Mattson | H01R 13/6658 439/660 |
| 2017/0133805 | A1 * | 5/2017 | Lewis | H01R 27/00 |

* cited by examiner

GATED CONNECTOR RECEPTACLES

BACKGROUND

Power and data may be provided from one electronic device to another over cables that may include one or more wires, fiber optic cables, or other conductors. Connector inserts may be located at each end of these cables and may be inserted into connector receptacles in the communicating or power transferring electronic devices.

These connector receptacles may typically be included on a device such that a user may make connections among devices to share power, data, or both. Some connector receptacles may be included for other reasons. For example, a test connector receptacle may be included on a device to allow access for test, debug, repair, programming, or other reasons.

Users might not typically connect to these test connector receptacles during normal operation. But under some circumstances, users may inadvertently attempt to access a device using one of these test connector receptacles. For example, users may not realize that it is a test connector receptacle and is not intended for their use. Other users may attempt to perform do-it-yourself repairs to the device housing the test connector receptacle. Others may simply make an inadvertent connection while trying to operate their device in a normal or prescribed manner.

These inadvertent connection attempts may take various forms. A test connector receptacle may be a conventional connector receptacle and a user may insert a corresponding connector insert. Other test connector receptacles may be close in shape or form to a conventional connector and this may lead a user to attempt to form a connection using a (nearly) corresponding connector insert.

Unfortunately, inadvertent connection attempts may result in actual connections that may damage the test connector receptacle, associated circuitry, or both. This may lead to an inability to perform test, debug, repair, programming or other operations on an electronic device. In a worst-case, it may remove a functionality from the device or render the electronic device inoperable. Accordingly, it may be desirable to reduce the possibility of these inadvertent connections.

Thus, what is needed are connector receptacles that may be arranged to avoid inadvertent connections.

SUMMARY

Accordingly, embodiments of the present invention may provide connector receptacles that may be arranged to avoid inadvertent connections. An illustrative embodiment of the present invention may provide contacts for a test, debug, repair, programming, or other type of connector receptacle (more simply, test connector receptacle) that may be located behind a movable gate such that inadvertent connections are reduced or avoided. The test connector receptacle may be combined with a second connector receptacle that is user accessible to save space and simplify device assembly. Combining the test connector receptacle and a second connector receptacle may also remove the movable gate from a surface of an electronic device, thereby further preventing inadvertent connections.

These test connector receptacles may be designed to be less robust and durable than conventional connector receptacles. For example, it may be expected that only trained parties such as technicians, engineers, store personnel, and others may access these test connector receptacles. Accordingly, these test connector receptacles may not need to be protected against electrostatic discharge (ESD) to the same extent as conventional connector receptacles. In these and other embodiments of the present invention, the test connector receptacles might not be conventional connector receptacles. Instead, they may be custom connector receptacles that are designed and arranged for their specific test, debug, or repair purposes. This may allow the use of off-the-shelf components for test connector receptacles, for example, connector receptacles that are designed for internal use in an electronic device.

Even though they are not intended to be accessed during normal operation, these test connector receptacles may still consume space in an electronic device. They may also need to be assembled as connector receptacles and then added to the assembly of the electronic devices housing them. Accordingly, embodiments of the present invention may combine a test connector receptacle with a conventional connector receptacle. These combined connector receptacles may be accessed by modified connector inserts that are arranged to mate with the test connector receptacle, the conventional connector receptacle, or both. This may allow simultaneous access to both the test connector receptacle and the conventional connector receptacle in the combined connector receptacle. In these and other embodiments of the present invention, the test connector receptacle may instead be combined with a non-conventional connector receptacle.

In these and other embodiments of the present invention, a movable gate of a test connector receptacle may be moved in different ways. For example, a modified connector insert may include a gate engaging feature that engages a portion of the movable gate such that as the modified connector insert is inserted into the combined connector receptacle, the movable gate moves out of the way and allows access to contacts of the test connector receptacle. In other embodiments of the present invention, a hardware or software button may be used to allow access to contacts of the test connector receptacle. In other embodiments of the present invention, turning a device upside-down or placing it in another position may allow access to contacts of the test connector receptacle.

In these and other embodiments of the present invention, a modified connector insert may include an extended front edge having a sloped or tapered surface. When the modified connector insert is inserted into a combined connector receptacle, the extended sloped front edge may contact a front engaging portion of a movable gate in the combined connector receptacle, where the movable gate covers contacts of a test connector receptacle. As the modified connector insert is fully inserted, the front engaging portion of the movable gate may move up onto a top surface of the modified connector insert. This may allow contacts on the modified connector insert to mate with contacts of the test connector receptacle. At the same time, other contacts on the modified connector insert may mate with contacts on a second connector receptacle in the combined connector receptacle. When the modified connector insert is removed, a spring may push the front engaging portion of the movable gate downward so that the movable gate covers the contacts of the test connector receptacle once again. While a front edge of the modified connector insert may be sloped, in other embodiments of the present invention the front edge of the modified connector insert may be squared off and a leading edge of the front engaging portion of the movable gate may be sloped or tapered. Also, while the movable gate may be driven upward, in other embodiments of the present invention the movable gate may pivot, swing, rotate, or move in another way.

In these and other embodiments of the present invention, the combined connector receptacle may accept a conventional connector insert, such as an RJ45 connector insert. In this way, a user may insert a conventional connector insert in the ordinary manner to access the functionality associated with a connector receptacle in the combined connector insert. In these and other embodiments of the present invention, a conventional connector insert might not be able to access contacts of the test connector receptacle.

Conventional connector receptacles and conventional connector inserts may be connector receptacles and connector inserts that are compliant with a standard. For example, an RJ45 connector receptacle or connector insert may be a connector receptacle or connector insert standardized as an 8P8C modular connector. Modified connector inserts may be similar to conventional connector inserts and they may have one or more features altered so that they may move a movable gate to gain access to contacts of a test connector receptacle. For example, where the modified connector insert is a modified RJ45 connector insert, a front edge of the connector insert may have an extended front portion having a sloped or angled surface to engage a front engaging portion of a movable gate. Without the extended sloped or angled front surface, a conventional RJ45 connector insert may not be long enough to move the front engaging portion of the movable gate and contacts of the test connector receptacle may remain behind the movable gate.

In these and other embodiments of the present invention, a combined connector receptacle may block access to a first set of contacts when no connector insert is inserted and when a conventional corresponding connector insert is inserted. The combined connector receptacle may allow access to the first set of contacts when a modified connector insert is inserted. The combined connector receptacle may allow access to a second set of contacts when either a conventional corresponding connector insert or a modified connector insert is inserted, and when no connector insert is inserted. A conventional corresponding connector insert may form electrical connections with the second set of contacts. A modified connector insert may form electrical connections with the first set of contacts and the second set of contacts. The first set of contacts may be for testing, debug, repair, programming, or other tasks. The second set of contacts may be contacts for a conventional or other connector receptacle, such as an RJ45 connector receptacle. Access to the first set of contacts may be blocked by a movable gate or other structure.

In these and other embodiments of the present invention, the test connector receptacle may instead be a connector insert. The connector insert may be for testing, debug, or repair and may be accessed via a movable gate. The test connector insert may be combined with a connector receptacle. This connector receptacle may be a conventional or non-conventional type of connector receptacle. A corresponding connector may be modified for mating with the test connector insert and the connector receptacle.

In these and other embodiments of the present invention, the contacts of the combined connector receptacles may include through-hole contacting portions. The through-hole contacting portions may fit in openings in a logic board to form electrical connections with traces in the logic board. These through-hole contacting portions may also provide mechanical stability for the combined receptacle. In other embodiments of the present invention, some or all of the contacts may terminate in surface-mount contacting portions.

While embodiments of the present invention may be useful in combined connector receptacles that include a second set of contacts for an RJ45 connector receptacle, these and other embodiments of the present invention may be used in other types of combine connector receptacles having a second set of contacts for different connector receptacles. For example, embodiments of the present invention may include a second set of contacts for a High-Definition Multimedia Interface® (HDMI) connector receptacle. This combined connector receptacle may be further configured to accept a conventional HDMI connector insert as well as a modified HDMI connector insert. In these and other embodiments of the present invention, a third set of contacts for a third connector receptacle may be included as well. For example, a third set of contacts for a Universal Serial Bus (USB) Type-C connector may be included and the combined connector receptacle may include a receptacle portion for accepting a USB Type C connector insert.

In various embodiments of the present invention, top and bottom shields, EMI or ground contacts, contacts, spring members, and other conductive portions of a connector receptacle may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the housings, movable gates, and other structures may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials. The printed circuit boards used may be formed of FR-4 or other material.

Embodiments of the present invention may provide combined connector receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, set-top boxes, adapters, remote control devices, chargers, and other devices. These combined connector receptacles may provide interconnect pathways for signals that are compliant with various standards such as one of the Universal Serial Bus (USB) standards including USB Type-C, HDMI, Digital Visual Interface (DVI), RJ45, Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide combined connector receptacles that may be used to provide a reduced set of functions for one or more of these standards. In various embodiments of the present invention, these interconnect paths provided by these combined connector receptacles may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
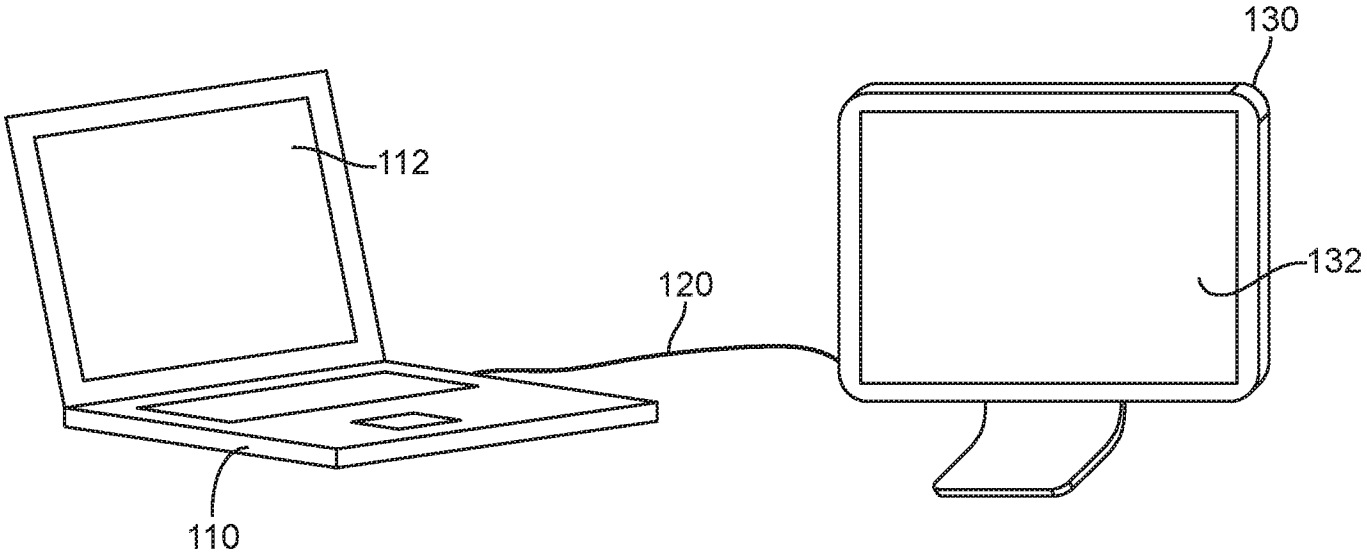
FIG. 1 illustrates an electronic system that may be improved by the incorporation of embodiments of the present invention.

FIG. 1 illustrates an electronic system that may be improved by the incorporation of an embodiment of the present invention. This figure, as with the other included figures, is shown for illustrative purposes and does not limit either the possible embodiments of the present invention or the claims.

This example illustrates monitor 130 that may be in communication with computer 110. Computer 110 may provide video or other data over cable 120 to monitor 130. Video data may be displayed on the video screen 132 of monitor 130. Computer 110 may similarly include a screen 112. In other embodiments the present invention, other types of devices may be included, and other types of data may be shared or transferred among the devices. For example, monitor 130 may be a monitor, an all-in-one computer, tablet computer, or other device. In these and other embodiments of the present invention, power may be shared between computer 110 and monitor 130 over cable 120.

Cable 120 may be one or a number of various types of cables. For example, it may be a Universal Serial Bus (USB) cable such as a USB Type-C cable, RJ45, Thunderbolt, DisplayPort, Lightning, or other type of cable. Cable 120 may include compatible connector inserts (not shown) that plug into connector receptacles (not shown) on the computer 110 and monitor 130.

It may be desirable to be able access devices such as computer 110 or monitor 130 for testing, debugging, repair, programming, or other reasons. Instead of adding an additional connector receptacle to provide this access, embodiments of the present invention may provide a combined connector receptacle that combines the functionality of one of the above conventional connector receptacles along with a test connector receptacle for testing, debugging, repair, programming, or other reasons. To avoid inadvertent connections to the test connector receptacle, contacts for the test connector receptacle may be located behind or covered by a movable gate. Examples are shown in the following figures.

Figure 2:
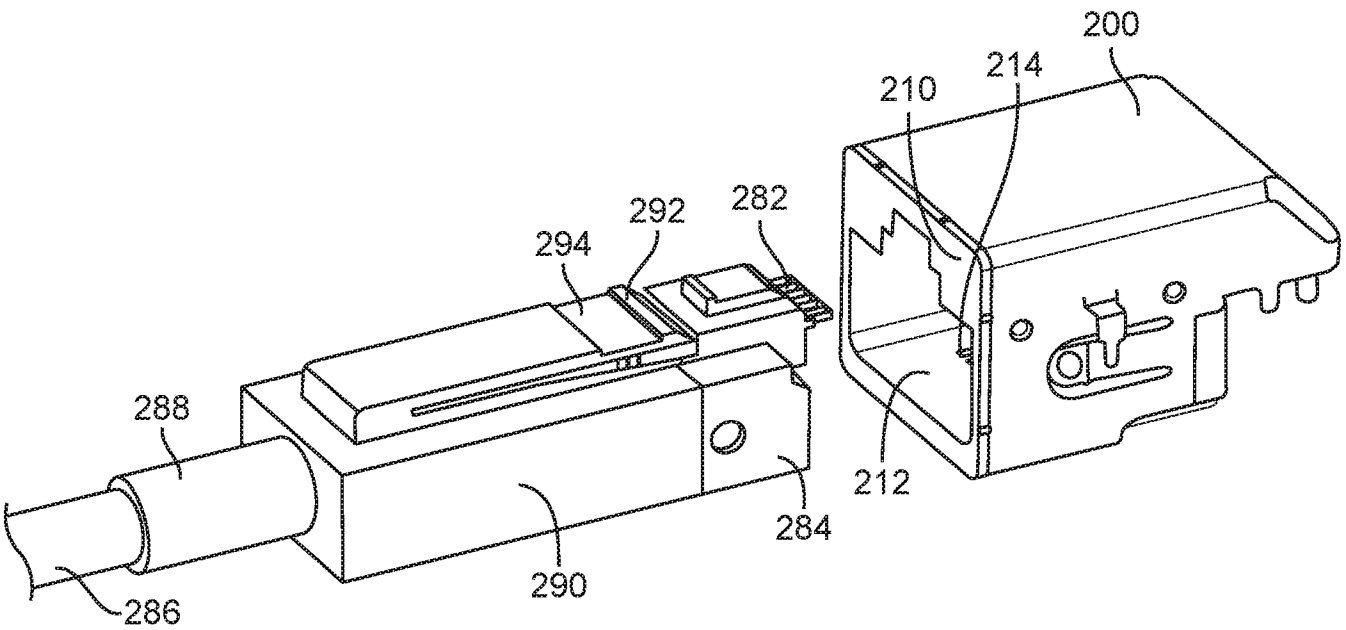
FIG. 2 illustrates a connector system according to an embodiment of the present invention.

FIG. 2 illustrates a connector system according to an embodiment of the present invention. This connector system includes modified connector insert 290 and combined connector receptacle 200. Modified connector insert 290 may include insert portion 284, which may be arranged to fit it front opening 212 of housing 210 of combined receptacle 200. Modified connector insert 290 may include first set of contacts 282 for engaging a first set of contacts (not shown) in combined connector receptacle 200. Modified connector insert 290 may further include a second set of contacts (not shown) for engaging second set of contacts 214 in combined connector receptacle 200. Modified connector insert 290 may include tab 292. Tab 292 may lock connector insert 290 in place in combined connector receptacle 200. Modified connector insert 290 may further include button 294. Button 294 may be depressed, thereby lowering tab 292 and allowing extraction of modified connector insert 290. Modified connector insert 290 may be connected to test, debug, repair, programming, or other hardware (not shown) via cable 286. Strain relief 288 may protect cable 286 during use.

Figure 3:
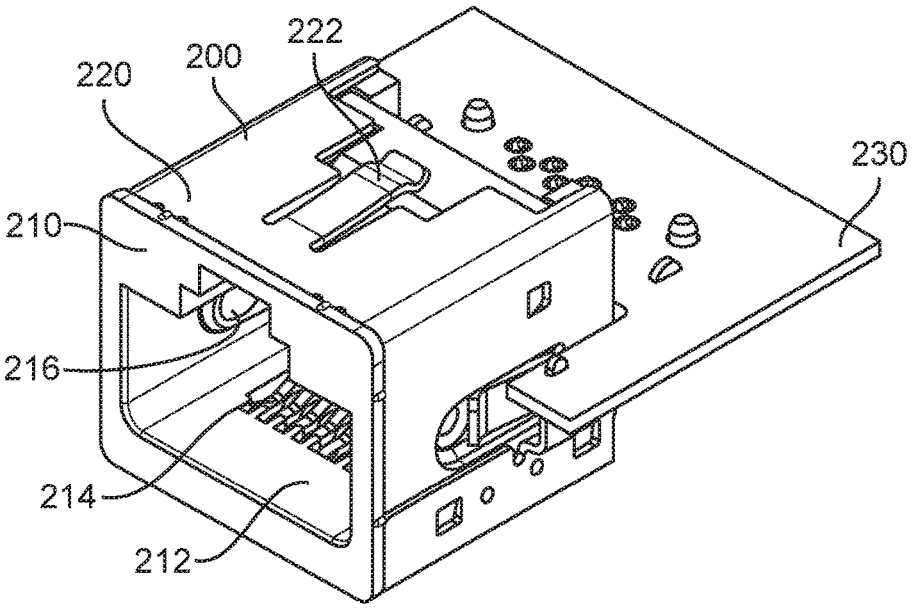
FIG. 3 illustrates a front view of a combined connector receptacle according to an embodiment of the present invention.
Figure 6:
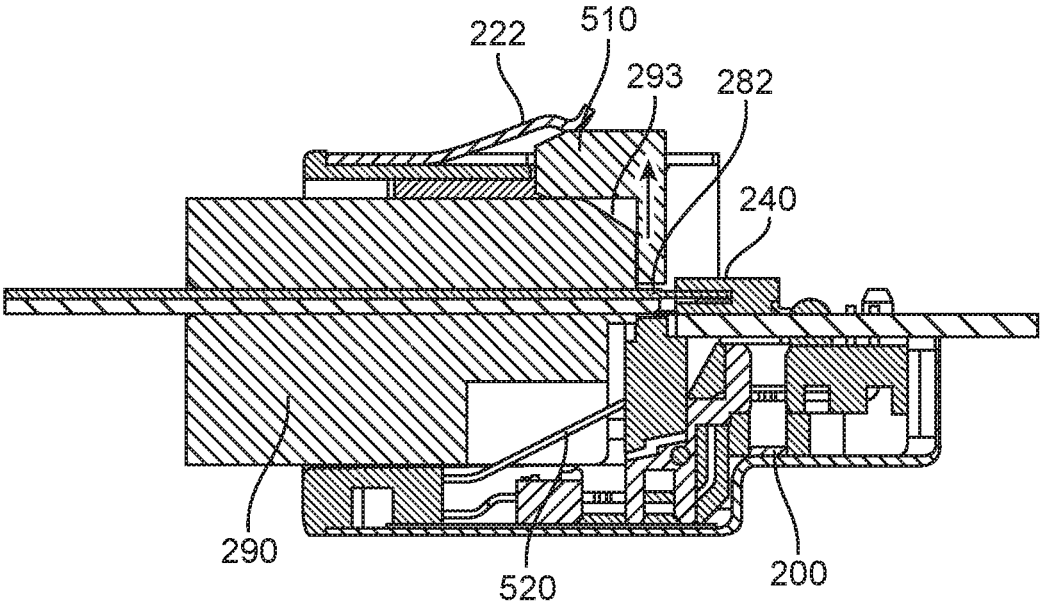
FIG. 6 is another cutaway side view of the connector system of FIG. 2.

FIG. 3 illustrates a front view of a combined connector receptacle according to an embodiment of the present invention. Combined connector receptacle 200 may include housing 210 having a front opening 212. Second set of contacts 214 may be located in opening 212. Electromagnetic (EMI) or ground contacts 216 may be located inside opening 212 of housing 210. A first set of contacts (not shown) may also be included in housing 210. The first set of contacts and the second set of contacts 214 may terminate on printed circuit board 230. Combined connector receptacle 200 may be shielded by shield 220. Shield 220 may include finger 222. Finger 222 may push down on a movable gate (not shown) thereby making the first set of contacts inaccessible unless the movable gate is moved, as shown in FIG. 6 below.

Figure 4:
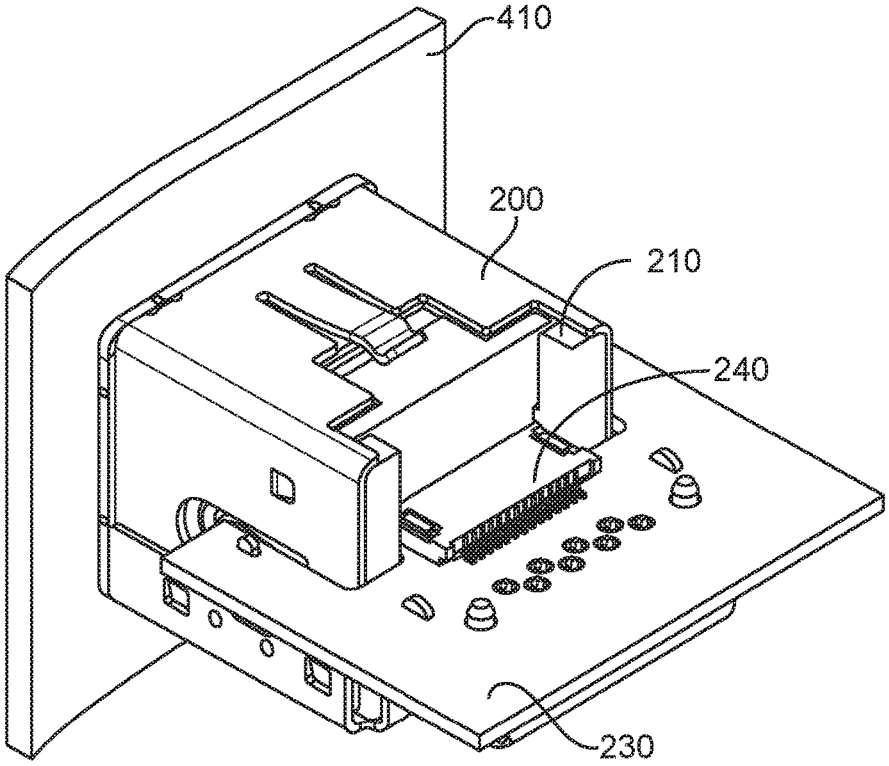
FIG. 4 illustrates a rear view of a combined connector receptacle according to embodiments of the present invention.

FIG. 4 illustrates a rear view of a combined connector receptacle according to embodiments of the present invention. Combined connector receptacle 200 may include housing 210 that may have a front opening 212 (show in FIG. 3) that may be located in an opening (not shown) in device enclosure 410. A first set of contacts (not shown) for test, debug, repair, programming, or other reasons may be located in connector receptacle 240. Connector receptacle 240 may be an off-the-shelf surface-mount technology (SMT) connector. Connector receptacle 240 may be a connector receptacle ordinarily configured for internal device use. Connector receptacle 240 may be located on print circuit board 230.

Figure 5:
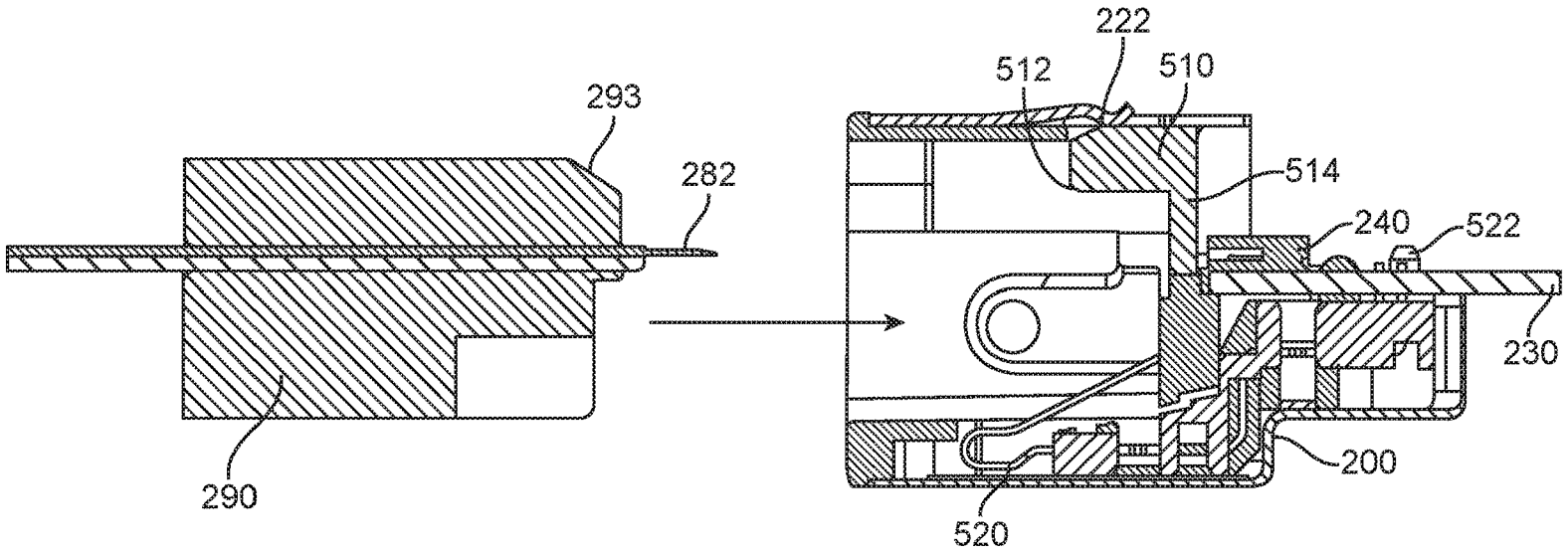
FIG. 5 is a cutaway side view of the connector system of FIG. 2.

FIG. 5 is a cutaway side view of the connector system of FIG. 2. Again, this connector system may include a modified connector insert 290 and combined connector receptacle 200. Connector insert 290 may be a modified connector insert having an extended front portion with an angled or sloped leading edge 293. Modified connector insert 290 may further have first set of contacts 282 and a second set of contacts (not shown).

Combined connector receptacle 200 may include connector receptacle 240 supporting a first set of contacts (not shown) for mating with first set of contacts 282 on modified connector insert 290. Combined connector receptacle 200 may include second set of contacts 520 for mating with a second set of contacts (not shown) on modified connector insert 290. The first set of contacts and second set of contacts 520 may terminate in through-hole contacting portions 522 on printed circuit board 230.

Combined connector receptacle 200 may include movable gate 510 to prevent access during normal use to the first set of contacts (not shown) in connector receptacle 240. That is, during normal use when either no connector insert or a corresponding conventional connector insert (not shown) is inserted into combined connector receptacle 200, movable gate 510 may prevent access to the first set of contacts in connector receptacle 240. When modified connector insert 290 is inserted into combined connector receptacle 200, an extended front portion with an angled or sloped leading edge 293 may engage edge 512 of movable gate 510. Moveable gate 510 may lift, pushing against finger 222, and thereby allowing access of the first set of contacts (not shown) in connector receptacle 240 to first set of contacts 282 on modified connector insert 290. When modified connector insert 290 is extracted, finger 222 may push down on movable gate 510, returning it to the closed position and cutting off access to the first set of contacts in connector receptacle 240. While front edge 293 of modified connector insert 290 may be sloped, in other embodiments of the present invention the front edge of modified connector insert 290 may be squared off and leading edge 512 of movable gate 510 may be tapered. Also, while movable gate 510 may be driven upward, in other embodiments of the present invention movable gate 510 may pivot, swing, rotate, or move in another way.

Conventional connector receptacles and conventional connector inserts may be connector receptacles and connector inserts that are compliant with a standard. For example, an RJ45 connector receptacle or connector insert may be a connector receptacle or a connector insert standardized as an 8P8C modular connector. Modified connector inserts may be similar to convention connector inserts and they may have one or more features altered so that they may move a movable gate to gain access to a test connector receptacle. Without these features, a conventional connector insert might not be able to move the movable gate to gain access to contacts of the test connector receptacle.

In these and other embodiments of the present invention, combined connector receptacle 200 may block access to a first set of contacts (not shown) when no connector insert is inserted and when a conventional corresponding connector insert (not shown) is inserted. When a conventional corresponding connector inserted, it may not have the length and sloped edge 293 to move movable gate 510. Combined connector receptacle 200 may allow access to the first set of contacts when modified connector insert 290 is inserted. Combined connector receptacle 200 may allow access to second set of contacts 520 when either a conventional corresponding connector insert or modified connector insert 290 is inserted, and when no connector insert is inserted. A conventional corresponding connector insert may form electrical connections with second set of contacts 520 when the conventional corresponding connector insert is inserted. Modified connector insert 290 may form electrical connections with the first set of contacts (not shown) and second set of contacts 520. The first set of contacts may be for testing, debug, repair, programming, or other tasks. Second set of contacts 520 may be contacts for a conventional or non-conventional connector receptacle, such as an RJ45 connector receptacle. Access to the first set of contacts may be blocked by movable gate 510 or other structure. In these and other embodiments of the present invention, movable gate 510 may be omitted. For example, a narrowness of a front opening of connector receptacle 240 may be thin enough that it may be relied upon to sufficiently reduce or prevent inadvertent contact with the first set of contacts. In these and other embodiments of the present invention, movable gate 510 may be replaced by a compressible gate made of foam or other compressible material that may be compressed out of the way by modified connector insert 290 or other modified connector insert.

FIG. 6 is another cutaway side view of the connector system of FIG. 2. In this figure, modified connector insert 290 may be inserted into combined connector receptacle 200. A first set of contacts (not shown) in connector receptacle 240 of combined connector receptacle 200 may be mated with first set of contacts 282 on modified connector insert 290. Second set of contacts 520 in combined connector receptacle 200 may be mated with a second set of contacts (not shown) on modified connector insert 290. Movable gate 510 may be pushed up against finger 222 by an extended front portion of modified connector insert 290 having sloped edge 293.

In the above examples, a separate connector receptacle 240 may be used to house a first set of contacts (not shown) for combined connector receptacle 200. In other embodiments of the present invention, a combined connector receptacle may house a first set of contacts along with a second set of contacts. An example is shown in the following figure.

Figure 7:
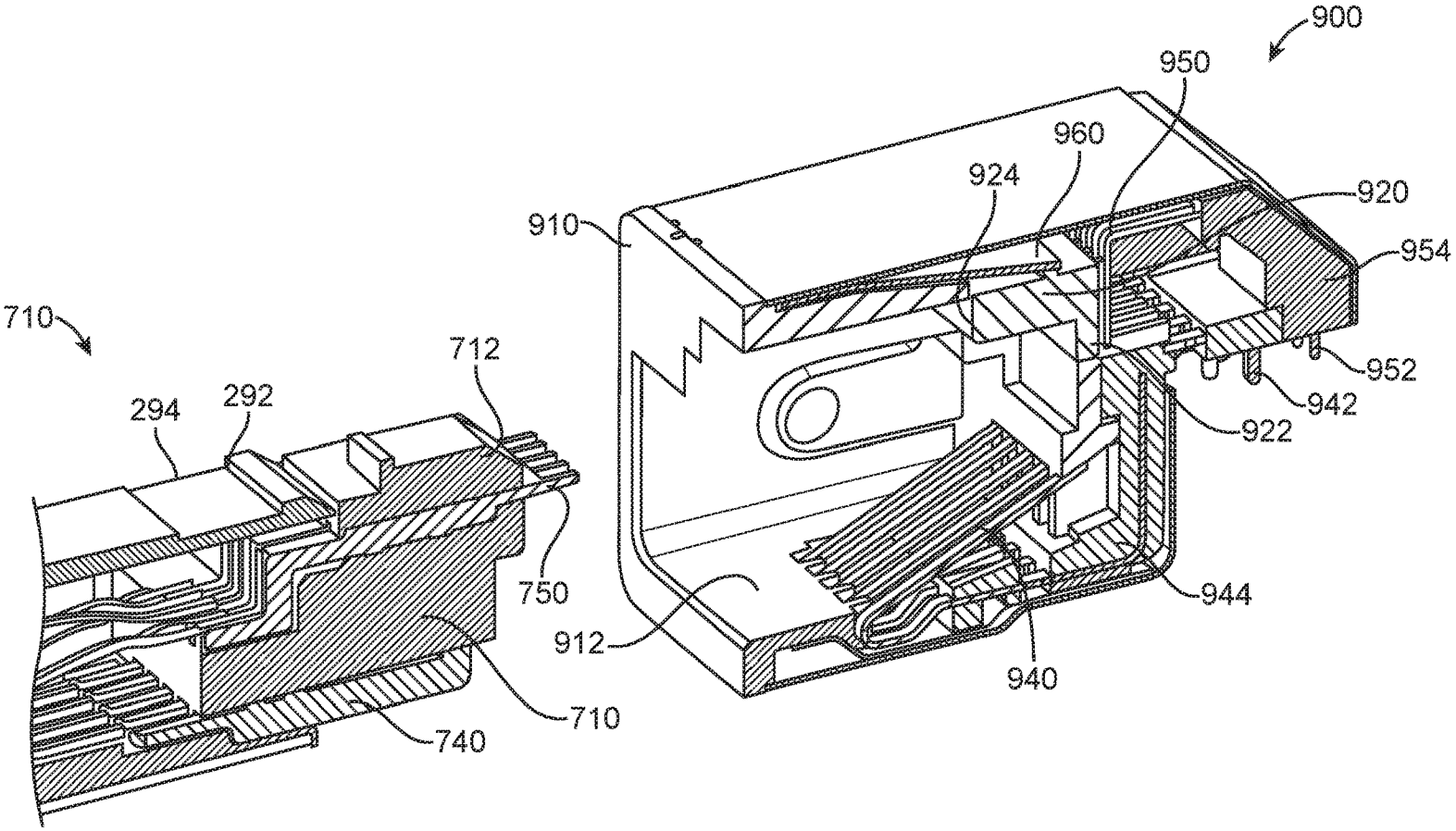
FIG. 7 illustrates a cross-section of a connector system according to an embodiment of the present invention.

FIG. 7 illustrates a cross-section of a connector system according to an embodiment of the present invention. This connector system may include a modified connector insert 710 and combined connector receptacle 900. Connector insert 710 may be a modified connector insert having an extended front portion with an angled or sloped leading edge 712. Modified connector insert 710 may further have first set of contacts 750 and second set of contacts 740. Modified connector insert 710 may be the same or similar to modified connector insert 290 (shown in FIG. 5). For example, modified connector insert 719 may include the same tab 292 and button 294.

Combined connector receptacle 900 may include housing 910 having opening 212. Combined connector receptacle 900 may include housing portion 954 supporting first set of contacts 950 for mating with first set of contacts 750 on modified connector insert 710. Combined connector receptacle 900 may include housing portion 945 supporting second set of contacts 940 for mating with second set of contacts 740 on modified connector insert 710. First set of contacts 950 and second set of contacts 940 may terminate in through-hole contacting portions 952 and 942 in a printed circuit board (not shown).

Combined connector receptacle 900 may include movable gate 920 to prevent access during normal use to first set of contacts 950. That is, during normal use when either no connector insert or a corresponding conventional connector insert (not shown) is inserted into combined connector receptacle 900, movable gate 920 may prevent access to first set of contacts 950. When modified connector insert 710 is inserted into combined connector receptacle 900, an extended front portion with an angled or sloped leading edge 712 may engage leading edge 924 of movable gate 920. Moveable gate 920 may lift, pushing against spring member 960, and thereby allowing access of first set of contact 950 in combined connector receptacle 900 to first set of contacts 750 on modified connector insert 710. When modified connector insert 710 is extracted, spring member 960 may push down on movable gate 920, returning it to the closed position such that gate portion 922 cuts off access to first set of contacts 950 in combined connector receptacle 900. While front edge 712 of the modified connector insert 710 may be sloped, in other embodiments of the present invention the front edge of modified connector insert may 710 be squared off and leading edge 924 on movable gate 920 may be tapered. Also, while movable gate 920 may be driven upward, in other embodiments of the present invention movable gate 920 may pivot, swing, rotate, or move in another way.

In these and other embodiments of the present invention, combined connector receptacle 900 may block access to first set of contacts 950 during normal operation, that is when no connector insert is inserted and when a conventional corresponding connector insert (not shown) is inserted. When a conventional corresponding connector inserted, it may not have the length or sloped edge 712 to move movable gate 920. Combined connector receptacle 900 may allow access to first set of contacts 950 when modified connector insert 710 is inserted. Combined connector receptacle 900 may allow access to second set of contacts 940 when either a conventional corresponding connector insert or modified connector insert 710 is inserted, and when no connector insert is inserted. A conventional corresponding connector insert may form electrical connections with second set of contacts 940 when the conventional corresponding connector insert is inserted. Modified connector insert 710 may form electrical connections with first set of contacts 950 and second set of contacts 940. First set of contacts 950 may be for testing, debug, repair, programming, or other tasks. Second set of contacts 740 may be contacts for a conventional or other connector receptacle, such as an RJ45 connector receptacle. Access to first set of contacts 950 may be blocked by movable gate 920 or other structure. In these and other embodiments of the present invention, movable gate 920 may be omitted. For example, a narrowness of an opening for first contacts 950 in combined connector receptacle 900 may be thin enough that it may be relied upon to sufficiently reduce or prevent inadvertent contact. In these and other embodiments of the present invention, movable gate 920 may be replaced by a compressible gate made of foam or other compressible material that may be compressed out of the way by modified connector insert 710 or other modified connector insert.

Figure 8:
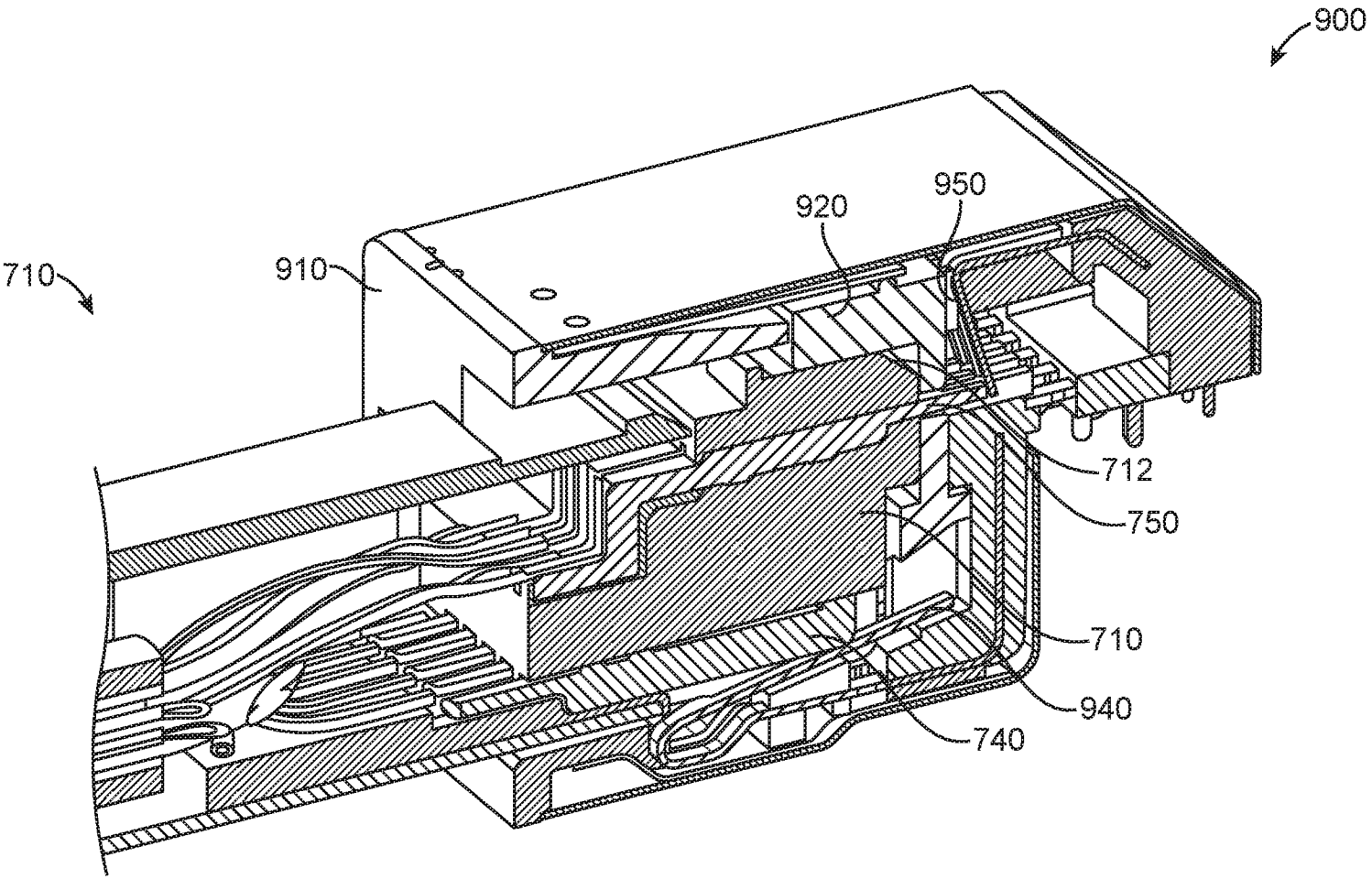
FIG. 8 illustrates another cross-section of a connector system according to an embodiment of the present invention

FIG. 8 illustrates a cross-section of a connector system according to an embodiment of the present invention. In this figure, modified connector insert 710 may be inserted into combined connector receptacle 900. First set of contacts 950 in combined connector receptacle 900 may be mated with first set of contacts 750 on modified connector insert 710. Second set of contacts 940 in combined connector receptacle 900 may be mated with second set of contacts 740 on modified connector insert 710. Movable gate 920 may be pushed up by an extended front portion of modified connector insert 710 having sloped edge 712.

Figure 9:
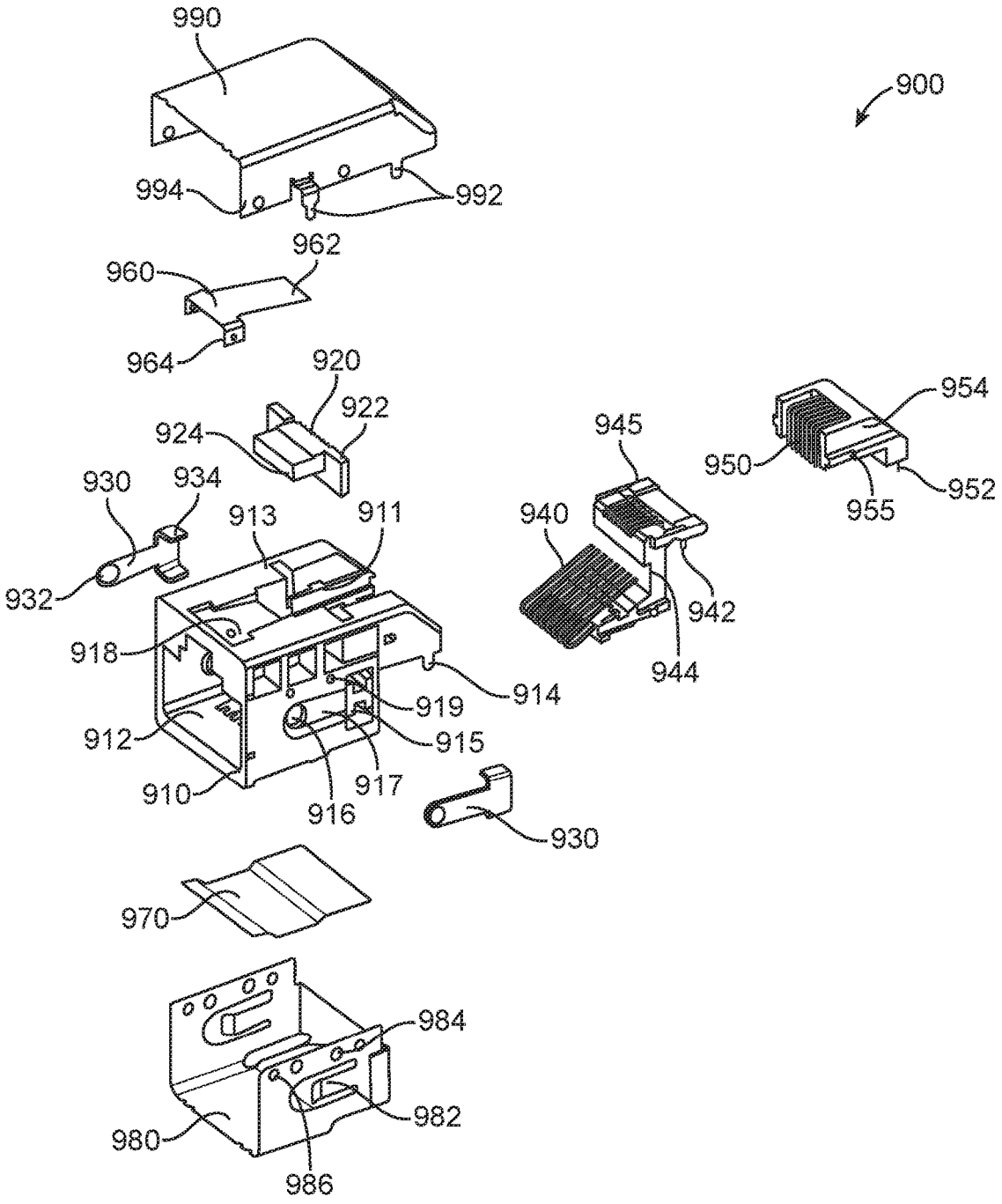
FIG. 9 illustrates an exploded view of a combined connector receptacle according to an embodiment of the present invention.

FIG. 9 illustrates an exploded view of a combined connector receptacle according to an embodiment of the present invention. Combined connector receptacle 900 may include housing 910. Housing 910 may include an opening 912 for accepting a corresponding connector insert (not shown) or a modified connector insert (not shown). Housing 910 may include openings 916, and slots 915 and 917. Housing 910 may further include slots 913 and 918 and raised portions 919. Housing 910 may further include posts 914. Posts 914 may be arranged to fit in openings in a printed circuit board (not shown) to provide mechanical stability for combined connector receptacle 900.

Combined connector receptacle 900 may further include EMI or ground contacts 930. EMI or ground contacts 930 may include contacting portions 932 which may fit in openings 916 in housing 910. EMI or ground contacts 930 may further include tabs 934 which may be inserted into slots 915 in housing 910. EMI or ground contacts 930 may fit in slots 915 in sides of housing 910.

Combined connector receptacle 900 may include moving gate 920. Moving gate 920 may include gate portion 922, which may be fit into slot 913 in housing 910. Moving gate 920 may further include leading edge 924.

Second set of contacts 940 may be partially housed by housing portion 944. Second set of contacts 940 may include through-hole contacting portions 942. Housing 944 may be inserted into housing 910. Specifically, edges 945 of housing 944 may be inserted into slots 911 in housing 910.

First set of contacts 950 may be partially housed by housing portion 954. First set of contacts 950 may include through-hole contacting portions 952. Through-hole contacting portions 942 and 952 may be inserted into openings in a printed circuit board (not shown) to which combined connector receptacle 900 is attached in order to form electrical connections to circuits and components (not shown) on or connected to the printed circuit board. Housing portion 954 may be inserted into housing 910. Specifically, edges 955 of housing portion 954 may also be inserted into slots 911 in housing 910.

Cam spring 960 may be inserted into housing 910. Specifically, spring member 960 may include tabs 964 that may be inserted into slots 918 in housing 910. Can spring 960 may include beam portion 962. Beam portion 962 of spring member 960 may push down on movable gate 920 after a modified connector insert is extracted from housing 910. Cam spring 960 may keep movable gate 920 in a closed position during normal use, that is, when either no connector insert or a conventional connector insert (not shown) is inserted into combined connector receptacle 900, thereby making second set of contacts 950 inaccessible.

Insulating layer 970 may be positioned between second set of contacts 940 and bottom shield 980. Insulating layer 970 may electrically insulate second set of contacts 940 from bottom shield 980. Insulating layer 970 may be formed of Kapton tape or other material.

Combined connector receptacle 900 may further include bottom shield 980 on a bottom side of housing 910. Bottom shield 980 may include fingers 982. Fingers 982 may push against EMI or ground contacts 930, thereby improving an electrical connection between a shield of a connector insert (not shown) inserted into housing 910 and EMI or ground contact 930. Bottom shield 990 may further include raised portions 986 and openings 984. Openings 984 may engage raised portions 919 on housing 910.

Combined connector receptacle 900 may further include top shield 900. Top shield 900 may include openings 994, which may accept raised portions 986 on bottom shield 980. Top shield 990 may further include tabs 992. Tabs 992 may fit in openings in a printed circuit board (not shown) thereby forming ground connections.

Figure 10:
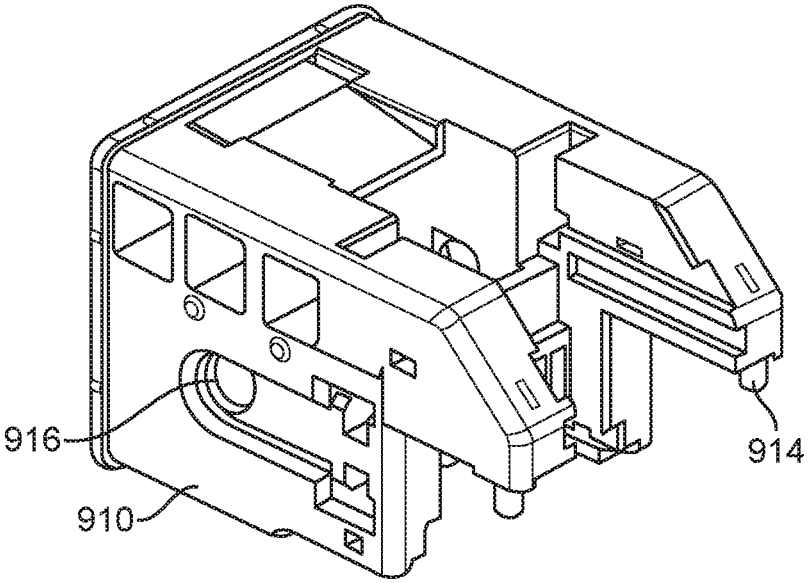
FIGS. 10-16 illustrate a method of manufacturing a combined connector receptacle according to an embodiment of the present invention.

FIGS. 10-16 illustrate a method of manufacturing a combined connector receptacle according to an embodiment of the present invention. In FIG. 10, housing 910 may be provided. Housing 910 may include an opening 912 (shown in FIG. 7). Housing 910 may further include side openings 916 for EMI or ground contacts 930 (shown in FIG. 9).

Figure 11:
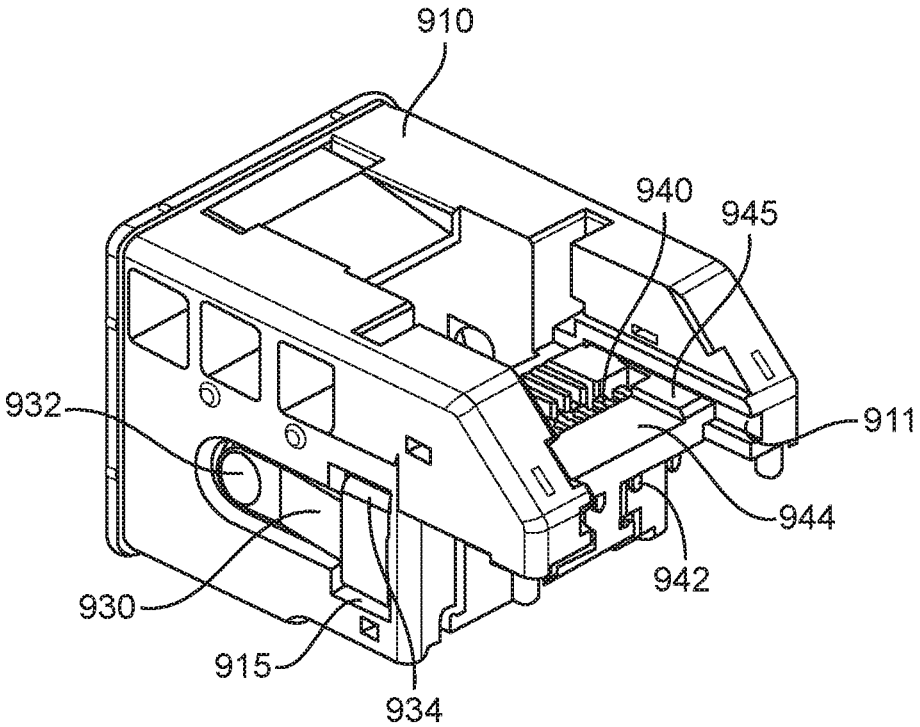

Housing 910 may include posts 914. Posts 914 may be inserted into openings in a printed circuit board or other appropriate substrate (not shown). In FIG. 11, EMI or ground contacts 930 may be attached to housing 910. EMI or ground contacts 930 may have contacting portions 932, which may fit in openings 916 (shown in FIG. 10). EMI or ground contacts 930 may include tabs 934 to fit in slots 915 in housing 910. Second set of contacts 940 and housing portion 944 may be inserted in housing 910. Specifically, edges 945 of housing portion 944 may fit in slots 911 in housing 910. Contacts 940 may include through-hole contacting portions 942. Housing portion 944 may be insert molded around contacts 940.

Figure 12:
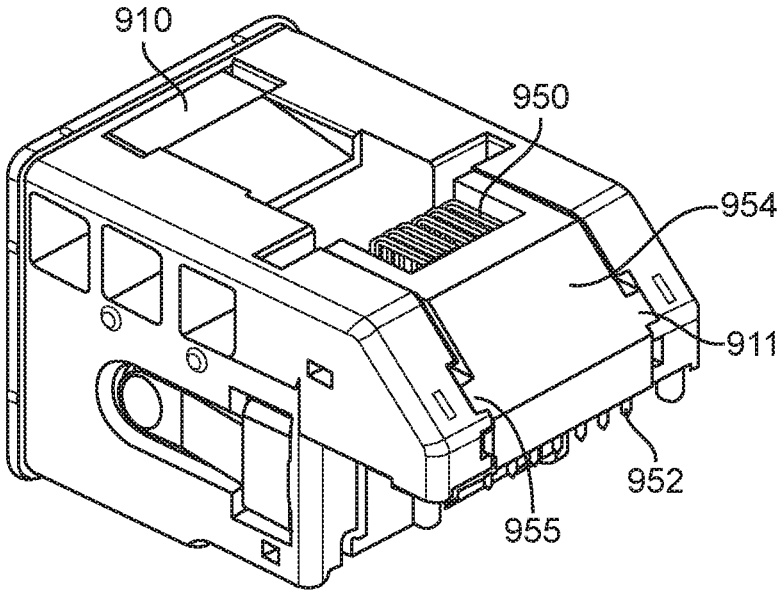
Figure 13:
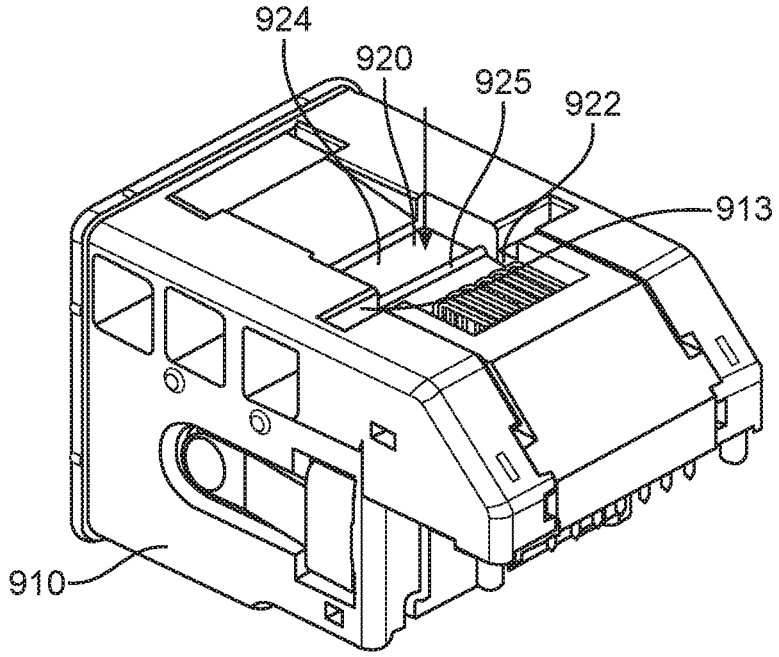
Figure 14:
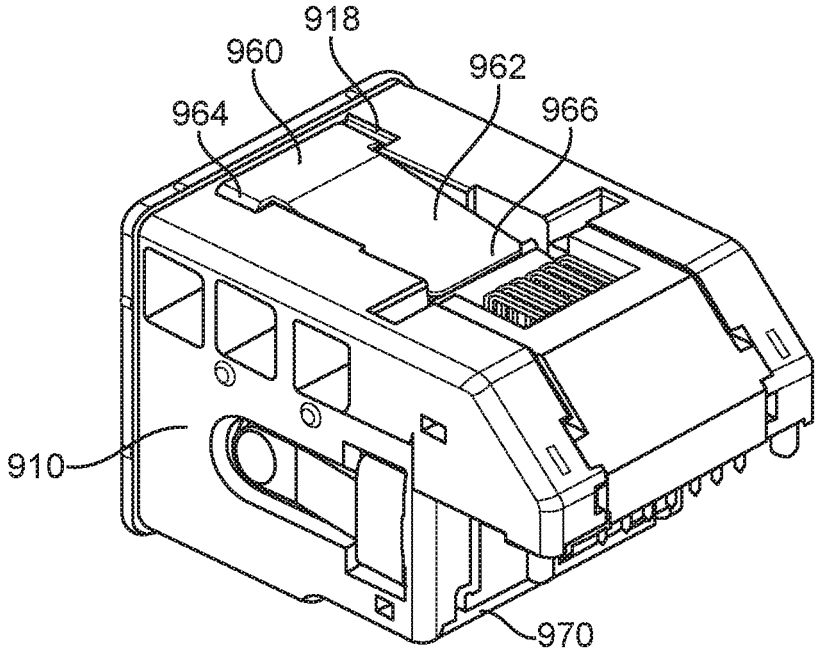

In FIG. 12, contacts 950 and housing portion 954 may be inserted into housing 910. Specifically, edges 955 of housing portion 954 may also be inserted in slot 911. Housing portion 954 may be insert molded around contacts 950. Contacts 950 may terminate in through-hole contacting portions 952. In FIG. 13, movable gate 920 may be inserted into housing 910. Specifically, movable gate 920 may include a gate portion 922 that may fit into slots 913 in housing 910. Movable gate 920 may also include leading edge 924. Movable gate 920 may also include trench 925. In FIG. 14, spring member 960 may be inserted into housing 110. Cam spring 960 may include beam portion 962. Edge 966 of spring member 960 may engage trench 925 of movable gate 20 as shown in FIG. 13. This may prevent movable gate 920 from moving when combined connector receptacle 900 (shown in FIG. 7) is turned upside-down. Cam spring 960 may include tabs 964 which may be inserted into slots 918 in housing 910. Also in FIG. 14, insulating layer 970 may be placed on a bottom of housing 910 to insulate second set of contacts 940 from bottom shield 980.

Figure 15:
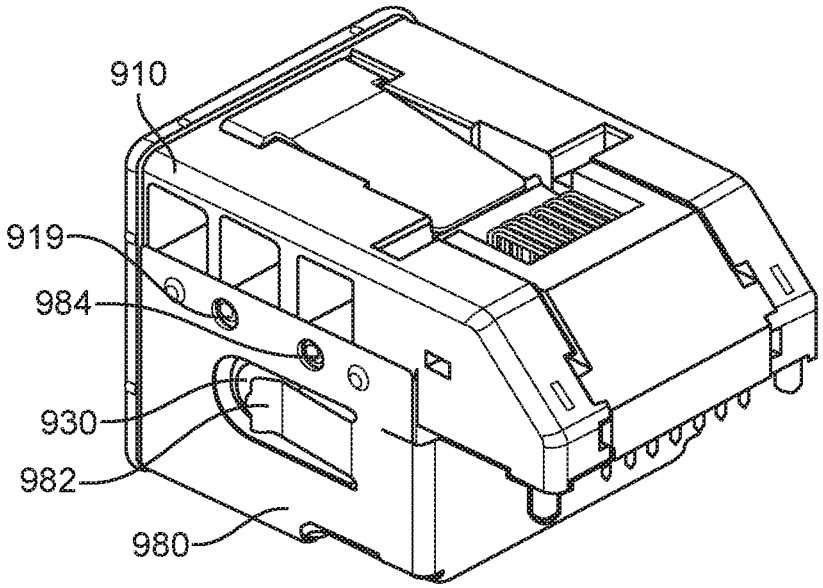
Figure 16:
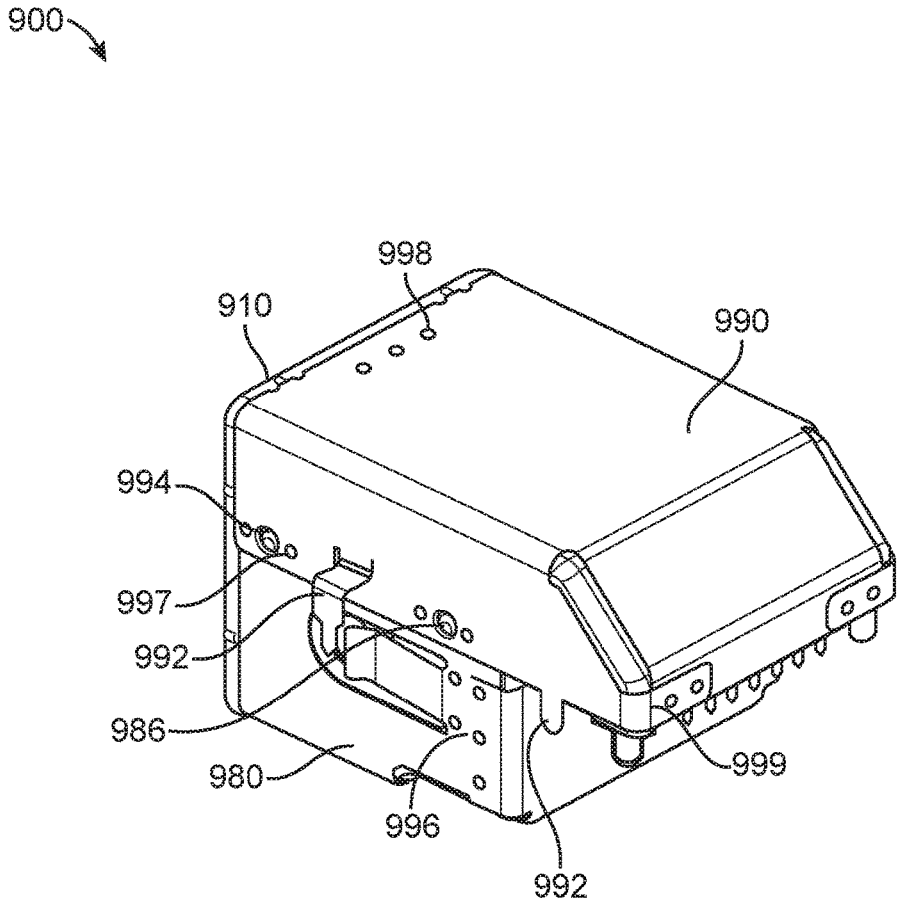

In FIG. 15, bottom shield 980 may be placed over a bottom side of housing 910. Bottom shield 980 may include openings 984 for accepting raised portions 919 on housing 910. Bottom shield 980 may further include fingers 982 for applying force to EMI or ground contacts 930 to improve a connection between EMI or ground contacts 930 and a shield of a connector insert (not shown). In FIG. 16, top shield 990 may be placed over a top of housing 910. Top shield 990 may include openings 994 for accepting raised portions 986 on bottom shield 980. Top shield 990 may include tabs 992. Top shield 990 may be spot or laser welded to bottom shield 980 at points 997, to itself at points 999, and to spring member 960 (shown in FIG. 14) at points 998. Bottom shield 980 may be spot or laser welded to EMI or ground contacts 930 (shown in FIG. 15).

Figure 17:
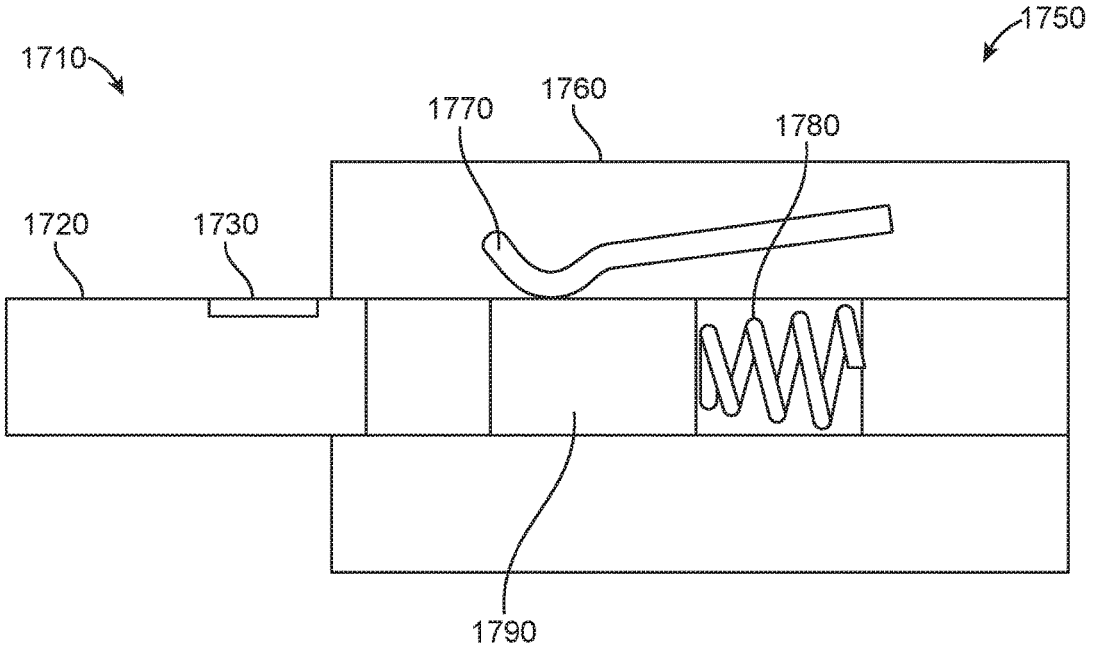
FIG. 17 is a simplified view of a connector system according to an embodiment of the present invention.

FIG. 17 is a simplified view of a connector system according to an embodiment of the present invention. Modified connector insert 1710 may include tongue or other portion 1720 supporting contact 1730. Combined connector receptacle 1750 may be a combined connector receptacle similar to the combined connector receptacles 200 and 900. Combined connector receptacle 1750 may include housing 1760 supporting first contacts 1770 for a test or other type of connector receptacle. Combined connector receptacle 1750 may further include movable gate 1790. Modified connector insert portion 1720 may slide movable gate 1790 into housing 1760, thereby compressing spring 1780 and exposing first contacts 1770. First contacts 1770 may form electrical connections with contacts 1730 of modified connector insert 1710. When modified connector insert 1710 is extracted, spring 1780 may push movable gate back into its original position thereby blocking access to first contacts 1770.

In these and other embodiments of the present invention, second set of contacts 940 and first set of contacts 950 may include through-hole contacting portions 942 and 952. Through-hole contacting portions 942 and 952 may fit in openings in a printed circuit board (not shown) to form electrical connections with traces (not shown) in the printed circuit board. These through-hole contacting portions 942 and 952 may also provide mechanical stability for the combined connector receptacle 900. In other embodiments of the present invention, some or all of contacts 940 and 950 may terminate in surface-mount contacting portions (not shown).

While embodiments of the present invention may be useful in adding functionality to an RJ45 connector receptacle, these and other embodiments of the present invention may be used in other types of connector receptacles for different interfaces. While embodiments of the present invention may be useful in combined connector receptacles that include second contacts 940 for an RJ45 connector receptacle, these and other embodiments of the present invention may be used in other types of combine connector receptacles having a second set of contacts for different connector receptacles. For example, embodiments of the present invention may include a second set of contacts for a High-Definition Multimedia Interface® (HDMI) connector receptacle. This combined connector receptacle may be further configured to accept a conventional HDMI connector insert as well as a modified HDMI connector insert. In these and other embodiments of the present invention, a third set of contacts for a third connector receptacle may be included as well. For example, a third set of contacts for a Universal Serial Bus (USB) Type-C connector may be included and the combined connector receptacle may include a receptacle portion for accepting a USB Type C connector insert.

In various embodiments of the present invention, top and bottom shields, EMI or ground contacts, contacts, spring members, and other conductive portions of a connector receptacle may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the housings, movable gates, and other structures may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials. The printed circuit boards used may be formed of FR-4 or other material.

Embodiments of the present invention may provide combined connector receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, set-top boxes, adapters, remote control devices, chargers, and other devices. These combined connector receptacles may provide interconnect pathways for signals that are compliant with various standards such as one of the Universal Serial Bus (USB) standards including USB Type-C, High-Definition Multimedia Interface® (HDMI), Digital Visual Interface (DVI), RJ45, Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide combined connector receptacles that may be used to provide a reduced set of functions for one or more of these standards. In various embodiments of the present invention, these interconnect paths provided by these combined connector receptacles may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A combined connector receptacle comprising:

a housing having a passage defining a front opening, an intermediate surface opposite the front opening, a first cavity between the front opening and the intermediate surface, and a second cavity behind the first cavity;

a first set of contacts located in the first cavity;

a second set of contacts located in the second cavity; and a movable gate that forms at least a portion of the intermediate surface and separates the first and second cavities when the movable gate is closed, and enables the second cavity to be accessed through the first cavity when the movable gate is open.

2. The combined connector receptacle of claim 1 wherein the front opening in the housing is configured to accept a connector insert.

3. The combined connector receptacle of claim 2 wherein the connector insert is an RJ45 connector insert.

4. The combined connector receptacle of claim 2 wherein the front opening in the housing is also configured to accept a modified connector insert, wherein the modified connector insert is modified to include an engaging feature to move the movable gate from closed to open when the modified connector insert is inserted into the front opening of the housing.

5. The combined connector receptacle of claim 4 wherein when the modified connector insert is removed from the front opening of the housing, a spring force closes the movable gate.

6. The combined connector receptacle of claim 5 wherein the spring force is provided by a spring member.

7. The combined connector receptacle of claim 5 wherein the movable gate comprises a gate portion located in a slot in the housing.

8. The combined connector receptacle of claim 7 wherein the movable gate further comprises a front engaging feature to contact the engaging feature on the modified connector insert when the modified connector insert is inserted into the combined connector receptacle.

9. The combined connector receptacle of claim 8 wherein the first set of contacts are supported by a first housing portion and each of the first set of contacts terminates in a through-hole connecting portion and the second set of contacts are supported by a second housing portion and each of the second set of contacts terminates in a through-hole connecting portion.

10. The combined connector receptacle of claim 9 wherein the second set of contacts are used for testing.

11. The combined connector receptacle of claim 10 wherein the first set of contacts are RJ45 contacts.

12. The combined connector receptacle of claim 9 further comprising ground contacts in side openings in the housing.

13. The combined connector receptacle of claim 12 further comprising a top shield over a top of the housing and a bottom shield under a bottom of the housing.

14. A combined connector receptacle comprising:

a housing having a front opening defined by a first cavity in the housing;

a first set of contacts located in the first cavity in the housing;

a second set of contacts located in a second cavity in the housing; and a movable gate located between the first cavity and the second cavity to block access through the first cavity to the second set of contacts in the second cavity when the movable gate is closed and to allow access through the first cavity to the second set of contacts when the movable gate is open.

15. The combined connector receptacle of claim 14 wherein the movable gate allows access to the second set of contacts during testing.

16. The combined connector receptacle of claim 15, wherein during testing, a corresponding connector insert is a modified connector insert that is inserted into the combined connector receptacle.

17. The combined connector receptacle of claim 15 wherein the movable gate moves vertically when a modified corresponding connector insert is horizontally inserted into the combined connector receptacle.

18. The combined connector receptacle of claim 14 wherein a corresponding connector insert is a nonstandard connector insert having a sloped surface near a leading edge and where a standard connector insert does not include the sloped surface.

19. The combined connector receptacle of claim 14 wherein a corresponding connector insert is a nonstandard RJ45 connector insert having a sloped surface near a leading edge and where a standard RJ45 connector insert does not include the sloped surface.

20. A combined connector receptacle comprising:

a connector receptacle housing having a first cavity defining a front opening, a movable gate opposite the front opening, the first cavity between the front opening and a first side of the movable gate, and a second cavity behind a second side of the movable gate;

a first set of contacts located in the first cavity, wherein the connector receptacle housing and the first set of contacts form a connector receptacle of a first type; and a second set of contacts located in the second cavity, wherein the connector receptacle housing and the second set of contacts form a connector receptacle of a second type, the second type different than the first type, wherein when the movable gate is closed, the movable gate separates the first and second cavities, and wherein when the movable gate is open, the movable gate enables the second cavity to be accessed through the first cavity.

21. The combined connector receptacle of claim 20 wherein the second set of contacts are accessed by a modified connector insert when the modified connector insert is inserted into the combined connector receptacle.

22. The combined connector receptacle of claim 20 wherein the first type of connector receptacle is an RJ45 connector receptacle, and where the second type of connector receptacle is a test connector receptacle.

* * * * *